US007658478B2

(12) United States Patent
Steiner et al.

(10) Patent No.: US 7,658,478 B2
(45) **Date of Patent: *Feb. 9, 2010**

(54) NON-CONDUCTIVE FLUID DROPLET FORMING APPARATUS AND METHOD

(75) Inventors: Thomas W. Steiner, Burnaby (CA); Fernando Luis de Souza Lopes, Richmond (CA)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 380 days.

This patent is subject to a terminal disclaimer.

(21) Appl. No.: 11/235,831

(22) Filed: Sep. 27, 2005

(65) Prior Publication Data

US 2006/0092230 A1 May 4, 2006

Related U.S. Application Data

(60) Provisional application No. 60/615,720, filed on Oct. 4, 2004.

(51) Int. Cl.
*B41J 2/115* (2006.01)

(52) U.S. Cl. ..... 347/80; 347/74; 347/73; 347/95; 347/100

(58) Field of Classification Search ..... 347/72–83, 347/6, 7, 95, 100
See application file for complete search history.

(56) References Cited

U.S. PATENT DOCUMENTS

| | | | | |
|---|---|---|---|---|
| 1,941,001 | A | 12/1933 | Hansell | |
| 3,060,332 | A * | 10/1962 | Anderson et al. | 307/149 |
| 3,373,437 | A | 3/1968 | Sweet et al. | |
| 3,462,285 | A * | 8/1969 | Thompson | 430/48 |
| 3,596,275 | A | 7/1971 | Sweet | |
| 3,787,881 | A * | 1/1974 | Duffield | 347/107 |
| 3,949,410 | A * | 4/1976 | Bassous et al. | 347/75 |
| 3,984,843 | A * | 10/1976 | Kuhn | 347/76 |
| 4,070,679 | A * | 1/1978 | Fan et al. | 347/75 |
| 4,123,760 | A * | 10/1978 | Hou | 347/77 |
| 4,190,844 | A | 2/1980 | Taylor | |
| 5,747,192 | A * | 5/1998 | Hughen et al. | 429/163 |
| 5,751,318 | A * | 5/1998 | Granzow | 347/68 |
| 6,079,821 | A | 6/2000 | Chwalek et al. | |
| 6,154,226 | A | 11/2000 | York et al. | |
| 6,158,844 | A * | 12/2000 | Murakami et al. | 347/55 |
| 6,312,110 | B1 | 11/2001 | Darty | |
| 6,508,542 | B2 * | 1/2003 | Sharma et al. | 347/77 |
| 6,554,410 | B2 * | 4/2003 | Jeanmaire et al. | 347/77 |
| 7,073,896 | B2 * | 7/2006 | Steiner et al. | 347/74 |
| 7,275,812 | B2 * | 10/2007 | Furukawa | 347/55 |
| 2004/0179069 | A1 | 9/2004 | Delametter et al. | |
| 2005/0206688 | A1 * | 9/2005 | Gelbart et al. | 347/74 |

* cited by examiner

*Primary Examiner*—Matthew Luu
*Assistant Examiner*—Henok Legesse
(74) *Attorney, Agent, or Firm*—William R. Zimmerli

(57) ABSTRACT

A method and apparatus for forming fluid droplets includes a nozzle channel, a pressurized source of a non-conductive fluid in fluid communication with the nozzle channel, and a stimulation electrode. The pressurized source is operable to form a jet of the non-conductive fluid through the nozzle channel. At least one portion of the stimulation electrode is electrically conductive and contactable with a portion of the non-conductive fluid jet. The at least one electrically conductive and contactable portion of the stimulation electrode is operable to transfer an electrical charge to a region of the portion of the non-conductive fluid jet with the electrical charge stimulating the non-conductive fluid jet to form a non-conductive fluid droplet.

15 Claims, 6 Drawing Sheets

NON-CONDUCTIVE FLUID DROPLET FORMING APPARATUS AND METHOD

CROSS REFERENCE TO RELATED APPLICATIONS

This is a 111A application of Provisional Application Ser. No. 60/615,720 filed Oct. 4, 2004.

This application is related to U.S. patent application Ser. No. 11/240,826 entitled Non-conductive Fluid Droplet Characterization Apparatus and Method, filed Sep. 30, 2005.

FIELD OF THE INVENTION

This invention relates generally to the field of digitally controlled fluid drop forming devices, and in particular to devices that form drops with non-conductive fluids.

BACKGROUND OF THE INVENTION

The use of ink jet printers for printing information on a recording media is well established. Printers employed for this purpose may be grouped into those that continuously emit a stream of fluid droplets, and those that emit droplets only when corresponding information is to be printed. The former group is generally known as continuous inkjet printers and the latter as drop-on-demand inkjet printers. The general principles of operation of both of these groups of printers are very well recorded. Drop-on-demand inkjet printers have become the predominant type of printer for use in home computing systems, whereas continuous inkjet systems find major application in industrial and professional environments. Typically, continuous inkjet systems produce higher quality images at higher speeds than drop-on-demand systems.

Continuous inkjet systems typically have a print head that incorporates a fluid supply system for fluid and a nozzle plate with one or more nozzles fed by the fluid supply. The fluid is jetted through the nozzle plate to form one or more thread-like streams of fluid from which corresponding streams of droplets are formed. Within each of the streams of droplets, some droplets are selected to be printed on a recording surface, while other droplets are selected not to be printed, and are consequently guttered. A gutter assembly is typically positioned downstream from the nozzle plate in the flight path of the droplets to be guttered.

In order to create the stream of droplets, a droplet generator is associated with the print head. The droplet generator stimulates the stream of fluid within and just beyond the print head, by a variety of mechanisms known in the art, at a frequency that forces continuous streams of fluid to be broken up into a series of droplets at a specific break-off point within the vicinity of the nozzle plate. In the simplest case, this stimulation is carried out at a fixed frequency that is calculated to be optimal for the particular fluid, and which matches a characteristic drop spacing of the fluid jet ejected from the nozzle orifice. The distance between successively formed droplets, S, is related to the jet velocity, v, and the stimulation frequency, f, by the relationship: $v=fS$. U.S. Pat. No. 3,596,275, issued to Sweet, discloses three types of fixed frequency generation of droplets with a constant velocity and mass for a continuous inkjet recorder. The first technique involves vibrating the nozzle itself. The second technique imposes a pressure variation on the fluid in the nozzle by means of a piezoelectric transducer placed typically within the cavity feeding the nozzle. A third technique involves exciting a fluid jet electrohydrodynamically (EHD) with an EHD droplet stimulation electrode.

Additionally, continuous inkjet systems employed in high quality printing operations typically require small closely spaced nozzles with highly uniform manufacturing tolerances. Fluid forced under pressure through these nozzles typically causes the ejection of small droplets, on the order of a few pico-liters in size, traveling at speeds from 10 to 50 meters per second. These droplets are generated at a rate ranging from tens to many hundreds of kilohertz. Small, closely spaced nozzles, with highly consistent geometry and placement can be constructed using micro-machining technologies such as those found in the semiconductor industry. Typically, nozzle channel plates produced by these techniques are typically made from materials such as silicon and other materials commonly employed in micromachining manufacture (MEMS). Multi-layer combinations of materials can be employed with different functional properties including electrical conductivity. Micro-machining technologies may include etching. Therefore through-holes can be etched in the nozzle plate substrate to produce the nozzles. These etching techniques may include wet chemical, inert plasma or chemically reactive plasma etching processes. The micro-machining methods employed to produce the nozzle channel plates may also be used to produce other structures in the print head. These other structures may include ink feed channels and ink reservoirs. Thus, an array of nozzle channels may be formed by etching through the surface of a substrate into a large recess or reservoir which itself is formed by etching from the other side of the substrate.

FIG. 1 schematically illustrates a prior art conventional electrohydrodynamic (EHD) stimulation means used to excite a jet of conductive fluid into a stream of droplets. Fluid supply 10 contains conductive fluid 12 under pressure which forces ink through nozzle channel 20 in the form of a conductive fluid jet 22. Conductive fluid 12 is grounded or otherwise connected through an electrical pathway. A prior art droplet stimulation electrode 15 is approximately concentric with an exit orifice 21 of nozzle channel 20 as shown in cross-section in FIG. 1A. Droplet stimulation electrode 15 typically includes a conductive electrode structure 13 produced from a variety of conductive materials, including a surface metallization layer, or from one or more layers of a semiconductor substrate doped to achieve certain conductivity levels. Prior art conductive electrode structure 13 is electrically connected to a stimulation signal driver 17 that produces a potential waveform of chosen voltage amplitude, period and functional relationship with respect to time in accordance to a stimulation signal 19. In FIG. 1, an example of a stimulation signal 19 comprises a uni-polar square wave with a 50% duty cycle. The resulting EHD stimulation is a function of the square of field strength created at the surface of the conductive fluid 12 near exit orifice 21. The resulting EHD stimulation induces charge in the conductive fluid jet 22 and creates pressure variations along the jet. Conductive electrode structure 13 is covered by one or more insulating layers 24 which are necessary to isolate droplet stimulation electrode 15 from conductive fluid 12 in order to prevent field collapse, excessive current draw and/or resistive heating of conductive fluid 12. The conductive fluid 12 must be sufficiently conductive to allow charge to move through the fluid from the grounded fluid supply 10 in order to electrohydrodynamically stimulate conductive fluid jet 22 to form droplets that subsequently form at break-off point 26. Since conductive fluids are employed, a non-uniform distribution of charge cannot be supported in the fluid jet column outside of the stimulating electric field. The electrohydrodynamic stimulation effect occurs due to the momentary induction of charge in conductive fluid 12 at nozzle orifice 20 that creates the pressure variation in fluid jet 22. For a correctly chosen frequency of the stimulation signal 19, the perturbation arising from the pressure variations will grow on the conductive fluid jet 22 until break-off occurs at the break-off point 26.

Various means for distinguishing or characterizing printing droplets from non-printing droplets in the continuous stream of droplets have been described in the art. One commonly used practice is that of electrostatic charging and electrostatic deflecting of selected droplets as described in U.S. Pat. No. 1,941,001, issued to Hansell, and U.S. Pat. No. 3,373,437, issued to Sweet et al. In these patents, a charge electrode is positioned adjacent to the break-off point of fluid jet. Charge voltages are applied to this electrode thus generating an electric field in the region where droplets separate from the fluid. The function of the charge electrode is to selectively charge the droplets as they break off from the fluid jet.

Referring back to FIG. 1, a typical prior art electrostatic droplet characterizing means includes charging electrode 30. Conductive fluid 12 is employed such that a current return path exists through the fluid supply 10 (e.g. through grounding). A charge is induced in a specific droplet under the influence of the field generated by charge electrode 30. This droplet charge is locked in on the droplet when it separates from the fluid jet 22. Charging electrode 30 is electrically connected to charge electrode driver 32. The charging electrode 30 is driven by a time varying voltage. The voltage attracts charge through conductive fluid 12 to the end of the fluid stream where it becomes locked-in or captured on charged droplets 34 once they break-off from the jet 22.

A high level of conductivity of fluid 12 is required to effectively charge droplets formed in these prior art systems. Prior art inkjet print heads that employ electrostatic droplet characterizing means typically use conductive fluid 12 conductivities on the order of 5 mS/cm. These conductivity levels permit induction of sufficient charge on charged droplets 34 to allow downstream electrostatic deflection. The conductivity required for droplet charging is typically much greater than that for droplet stimulation. Typically, a conductive fluid suitable for charging can also be stimulated using EHD principles. The selective charging of the droplets in conventional electrostatic prior art inkjet systems allows each droplet to be characterized. That is, the conductive inks permit charges of varying levels and polarities to be selectively induced on the droplets such that they can be characterized for different purposes. Such purposes may include selectively characterizing each of the droplets to be used for printing or to not be used for printing.

Again referring to the prior art system shown in FIG. 1, a potential waveform produced by the charging electrode driver 32 will determine how the formed droplets will be characterized. The potential waveform will determine which of the formed droplets will be selected for printing and which of the formed droplets will not be selected for printing. Droplets in this example are characterized by charging as shown by charged droplets 34 and uncharged droplets 36. Since a specific droplet characterization is dependant upon whether that droplet is printed with or not, the potential waveform will typically be based at least in part on a print-data stream provided by one or more systems controllers (not shown). The print-data stream typically comprises instructions as to which of the specific droplets within the stream of droplets are to be printed with, or not printed with. The potential waveform will therefore vary in accordance with the image content of the specific image to be reproduced.

Additionally, the potential waveform may also be based on methods or schemes employed to improve various printing quality aspects such as the placement accuracy of droplets selected for printing. Guard drop schemes are an example of these methods. Guard drop schemes typically define a regular repeating pattern of specific droplets within the continuous stream of droplets. These specific droplets, which may be selected to print with if required by the print-data stream, are referred to as "print-selectable" droplets. The pattern is additionally arranged such that additional droplets separate the print-selectable droplets. These additional droplets cannot be printed with regardless of the print-data stream and are referred to as "non-print selectable" droplets. This is done so as to minimize unwanted electrostatic field effects between the successive print-selectable droplets. Guard drop schemes may be programmed into one or more systems controllers (not shown) and will therefore alter the potential waveform so as to define the print-selectable droplets. The voltage waveform will therefore characterize printing droplets from non-printing droplets by selectively charging individual droplets within the stream of droplets in accordance with the print data stream and any guard drop scheme that is employed.

Again referring to the prior art system shown in FIG. 1, electrostatic deflection plates 38 placed near the trajectory of the characterized droplets interact with charged droplets 34 by steering them according to their charge and the electric field between the plates. In this example, charged droplets 34 that are deflected by deflection plates 38 are collected on a gutter 40 while uncharged droplets 36 pass through substantially un-deflected and are deposited on a receiver surface 42. In other systems, this situation may be reversed with the deflected charged droplets being deposited on the receiver surface 42. In either case, further complications arise from the fact that the charging electrode driver 32 must be synchronized with stimulation signal driver 17 to ensure that optimum charge levels are transferred to droplets, thus ensuring accurate droplet printing or guttering as the architecture of the recorder may dictate. These synchronization constraints arise as result of charging or characterizing those conductive fluid droplets at a place and time separate from their stimulation. Although prior art electrostatic characterization and deflection systems are advantageous in that they permit large droplet deflection, they have the disadvantage that they have been used primarily only with conductive fluids, thus limiting the applications of these systems.

A wide range of fluid properties is desirable in commercial inkjet applications. Jetted inks may be made with pigments or dyes suspended or dissolved in fluid mediums comprised of oils, solvents, polymers or water. These fluids typically have a large range of physical properties including viscosity, surface tension and conductivity. Some of these fluids are considered to be non-conductive fluids, and thus have insufficient levels of conductivity so as to be employed in continuous inkjet systems that rely on the selective electrostatic charging and deflection of conductive fluid droplets.

Various systems and methods for stimulating a non-conductive fluid medium to form a series of droplets and for characterizing the series of droplets to form "printing" droplets and "non-printing" droplets have been proposed. For example, U.S. Pat. No. 3,949,410, issued to Bassous et al., teaches use of a monolithic structure useful for the EHD stimulation of conductive fluid droplets in a jet stream emitted from a nozzle.

U.S. Pat. No. 6,312,110, issued to Darty, and U.S. Pat. No. 6,154,226, issued to York et al., teach the construction of various inkjet print heads wherein droplets are not stimulated from a stream of non-conductive fluid. Rather, the print heads comprises EHD pumps within the print head nozzles themselves. Droplets are ejected from the fluid supply in a similar fashion to drop-on-demand printers.

U.S. Pat. No. 4,190,844, issued to Taylor, teaches a use of a first pneumatic deflector for deflecting non-printing ink droplets towards a droplet catcher. A second pneumatic deflector either creates an "on-off" basis for line-at-a-time printing, or a continuous basis for character-by-character printing.

U.S. Pat. No. 6,079,821, issued to Chwalek et al., teaches a use of asymmetric heaters to both create and deflect individual droplets formed in a continuous inkjet recorder. Deflection of the droplets occurs by the asymmetrical heating of the jetted stream.

U.S. Pat. No. 4,123,760, issued to Hou, teaches the use of deflection electrodes upstream of a break-off point from which droplets are formed from a corresponding jetted fluid stream. Droplets produced by the stream are steered to different laterally separated printing locations by applying a cyclic differential charging signal to the deflection electrodes. This causes a deflection of the unbroken fluid stream which directs the droplets towards their desired printing positions.

It can be seen that there is a need to provide an apparatus and method of stimulating or forming a non-conductive fluid droplet or droplets from a jet of non-conductive fluid.

SUMMARY OF THE INVENTION

According to a feature of the present invention, an apparatus for forming fluid droplets includes a nozzle channel, a pressurized source of a non-conductive fluid in fluid communication with the nozzle channel, and a stimulation electrode. The pressurized source is operable to form a jet of the non-conductive fluid through the nozzle channel. At least one portion of the stimulation electrode is electrically conductive and contactable with a portion of the non-conductive fluid jet. The at least one electrically conductive and contactable portion of the stimulation electrode is operable to transfer an electrical charge to a region of the portion of the non-conductive fluid jet with the electrical charge stimulating the non-conductive fluid jet to form a non-conductive fluid droplet.

According to another feature of the present invention, a method of forming fluid droplets includes providing a jet of a non-conductive fluid; providing an electrical charge on an electrically conductive portion of a stimulation electrode; and stimulating the non-conductive fluid jet to form a non-conductive fluid droplet by transferring the electrical charge from the electrically conductive portion of the stimulation electrode to a portion of the non-conductive fluid jet.

According to another feature of the present invention, a stimulation electrode for forming a fluid droplet from a non-conductive fluid jet includes at least one electrically conductive portion contactable with a portion of the non-conductive fluid jet operable to transfer an electrical charge to a region of the portion of the non-conductive fluid jet such that the electrical charge stimulates the non-conductive fluid jet to form a non-conductive fluid droplet.

According to another feature of the present invention, a droplet or a stream of droplets is formed from a corresponding jet of non-conductive fluid. A droplet stimulation electrode is used to stimulate the jet of non-conductive fluid to form each of the droplets in the stream. The droplet stimulation electrode transfers charge to one or more regions of the non-conductive fluid jet. The transferred charges cause the jet to be stimulated such that a given droplet is typically formed from the corresponding regions of the jet. The specific droplet can include at least in part of the charge that has been transferred to the corresponding region or regions from which it was formed. One or more systems controllers are used create and provide a droplet stimulation signal. The droplet stimulation signal includes a waveform that is structured in accordance with the required sequence of droplets to be formed. The droplet stimulation signal is provided to a droplet stimulation driver that in turn provides a potential waveform to the droplet stimulation electrode so as to selectively transfer charge the various regions of the non-conductive fluid jet. This transfer of charge is used electrohydrodynamically stimulate the various regions of the jet to form corresponding droplets.

In addition to the exemplary features and embodiments described above, further aspects and embodiments will become apparent by reference to the drawings and the detailed description.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus and method in accordance with the present invention. It is to be understood that elements not specifically shown or described may take various forms well known to those skilled in the art.

Figure 1:
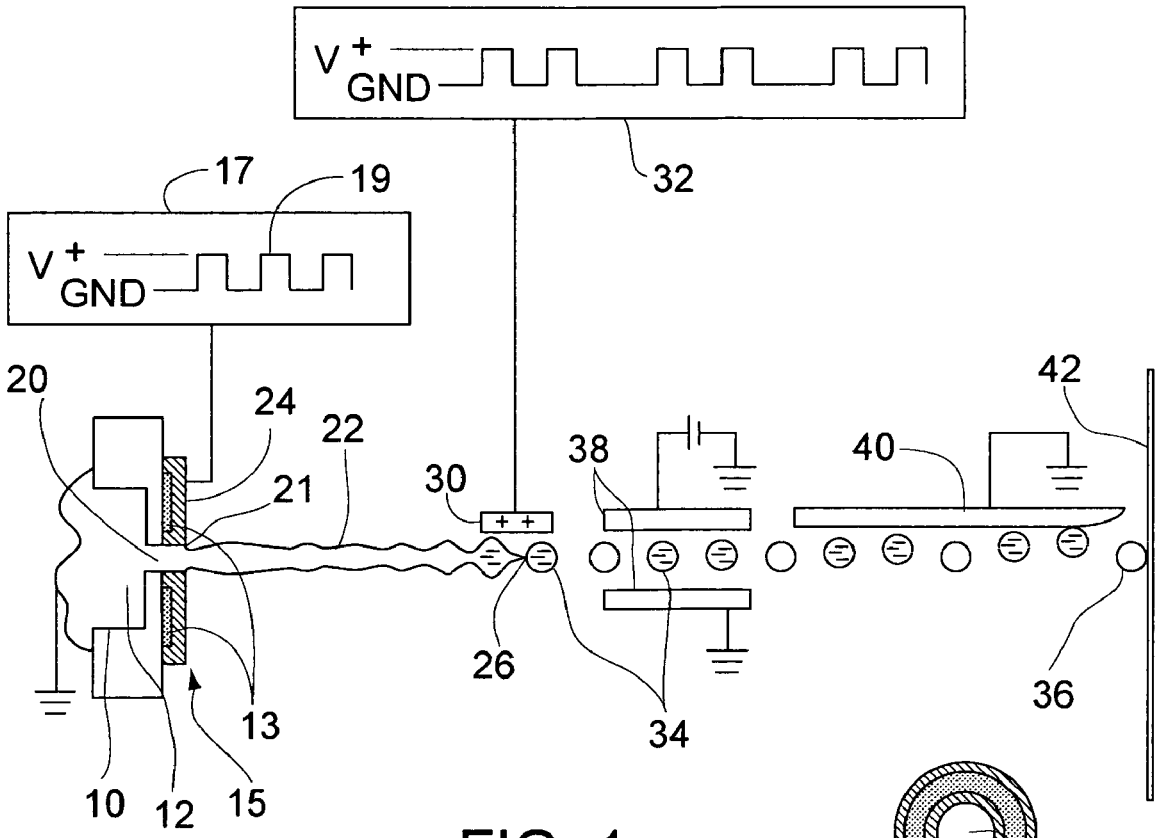
FIG. 1 PRIOR ART
FIG. 1 is a schematic representation of a prior art inkjet recording apparatus having electrostatic charging and deflection means.
Figure 1A:
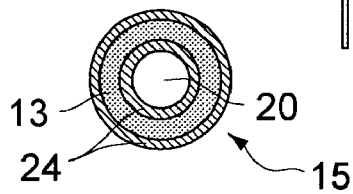
FIG. 1A PRIOR ART
FIG. 1A is a cross-sectional view of a prior art droplet stimulation electrode as shown in FIG. 1.
Figure 2:
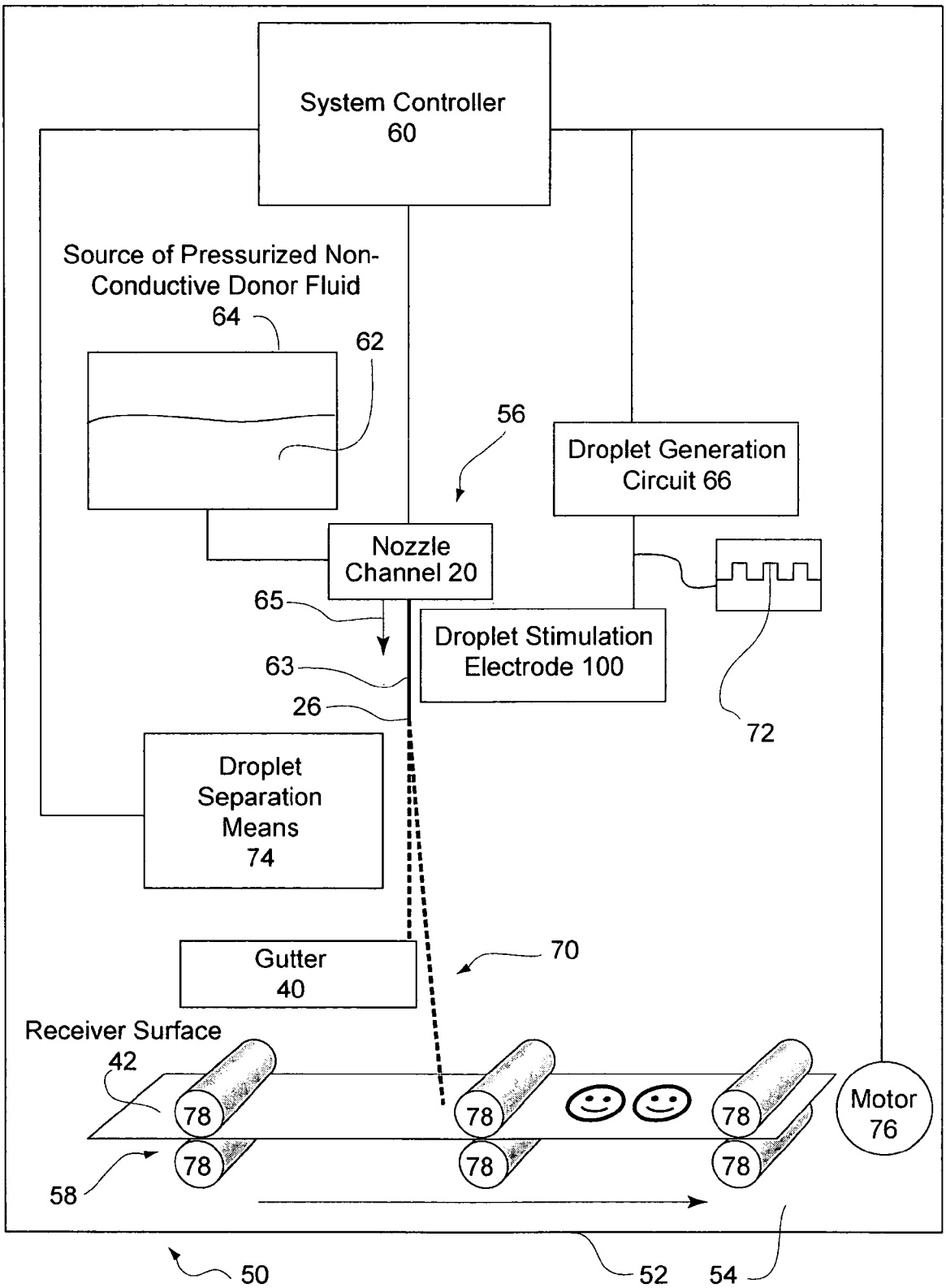
FIG. 2 is a schematic representation of a printing apparatus including an example embodiment of the present invention.

FIG. 2 schematically shows a printing apparatus 50 including an example embodiment of the present invention. Printing apparatus 50 comprises a housing 52 that can comprise any of a box, closed frame, continuous surface or any other enclosure defining an interior chamber 54. In the embodiment of FIG. 2, interior chamber 54 of housing 52 holds an inkjet print-head 56, a translation unit 58 that positions a receiver surface 42 relative to inkjet print-head 56, and system controller 60. System controller 60 may comprise a micro-computer, micro-processor, micro-controller or any other known arrangement of electrical, electromechanical and electro-optical circuits and systems that can reliably transmit signals to inkjet print-head 56 and translation unit 58 to allow the pattern-wise disposition of non-conductive donor fluid 62 onto receiver surface 42. System controller 60 may comprise a single controller or it can comprise a plurality of controllers.

As shown in FIG. 2, inkjet print-head 56 includes a source of pressurized non-conductive donor fluid 64 such as a pressurized reservoir or a pump arrangement and a nozzle channel 20 allowing the pressurized non-conductive donor fluid 62 to form a non-conductive fluid jet 63 traveling in a first direction 65 toward receiver surface 42. A droplet generation circuit 66 is in electrical communication with a droplet stimulation (or formation) electrode 100 of the present invention. In response to a droplet stimulation (or formation) signal 72, droplet stimulation electrode 100 applies a force to non-conductive fluid jet 63 to perturb fluid jet 63 to form a stream of droplets 70 at a break-off point 26. Discrete or integrated components within the droplet generation circuit 66 such as timing circuits of a type well known to those of skill in the art may be used or adapted for use in generating the droplet stimulation signal 72 to form droplets.

Selected droplets within the stream of droplets 70 may be characterized to be printed with or not to be printed with. A droplet separation means 74 is used to separate droplets selected for printing from the other droplets based on this characterization. Droplet separation means 74 may include any suitable means that can separate the droplets based on the characterization scheme that is employed. Without limitation, droplet separation means 74 may include one or more electrostatic deflection plates operable for applying an electrostatic force to separate droplets within the stream of droplets 70 when the characterization scheme involves the selective charging of droplets. When the droplets are characterized by selectively forming them with different sizes or volumes, droplet separation means 74 may include a lateral gas deflection apparatus as taught, for example, by Jeanmaire et al., in U.S. Pat. No. 6,554,410. In U.S. Pat. No. 6,554,410, a continuous gas source is positioned at an angle with respect to a stream of droplets. The stream of droplets is composed of a plurality of volumes. The gas source is operable to interact with the stream of droplets thereby separating droplets consisting of one the plurality of volumes from droplets consisting of another plurality of volumes. As shown in FIG. 2, droplet separation means 74 is employed to deposit some characterized droplets onto receiver surface 42 while the remaining droplets are deposited on gutter 40.

Droplets 70 can also be characterized using other devices and methods, see, for example, U.S. patent application Ser. No. 11/240,826 entitled Non-conductive Fluid Droplet Characterization Apparatus and Method, filed Sep. 30, 2005.

In the embodiments described with reference to FIGS. 3 through 6*a*, at least one apparatus and method are described for stimulating non-conductive donor fluid 62 in inkjet print-head 56. It will be understood that non-conductive donor fluid 62 is not limited to an ink and may comprise any non-conductive fluid that can be caused to form a jet and droplets as described herein. Typically, non-conductive donor fluid 62 includes a colorant, ink, dye, pigment, or other image forming material. However, donor fluid 62 can also carry dielectric material, electrically insulating material, or other functional material.

Further, in the embodiment illustrated in FIG. 2, receiver surface 42 is shown as comprising a generally paper type receiver medium, however, the invention is not so limited and receiver surface 42 may comprise any number of shapes and forms and may be made of any type of material upon which a pattern of non-conductive donor fluid 62 may be imparted in a coherent manner. Accordingly, in the embodiment illustrated in FIG. 2, translation unit 58 has been shown as having a motor 76 and arrangement of rollers 78 that selectively positions a paper type receiver surface 42 relative to a stationary inkjet print-head 56. This too is done for convenience and it will be appreciated, that receiver surface 42 may comprise any type of receiver surface 42 and translation unit 58 will be adapted to position either one of the receiver surface 42 and inkjet print-head 56 relative to each other.

Figure 3:
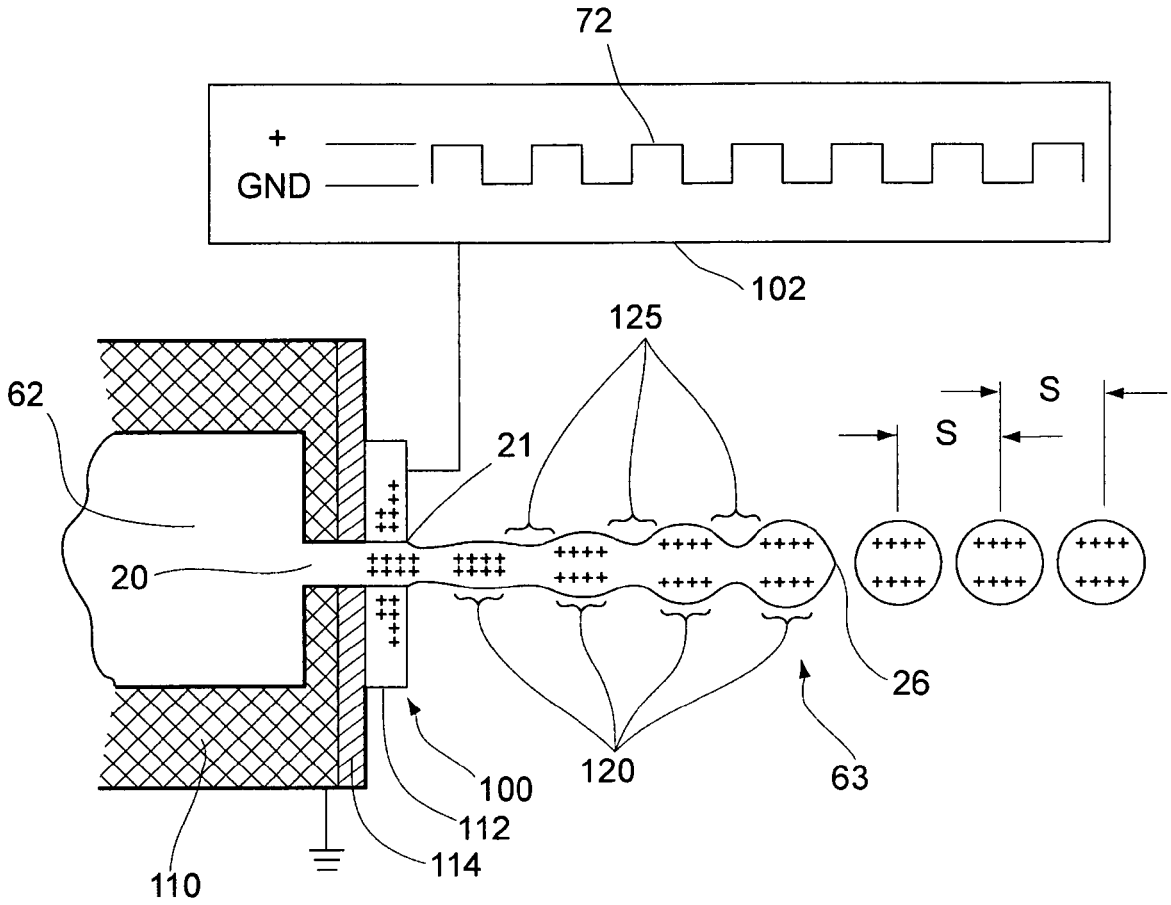
FIG. 3 is a schematic representation of an apparatus including an example embodiment of a droplet stimulation device made in accordance with the present invention.

FIG. 3 schematically shows droplet stimulation electrode 100 for stimulating a stream of droplets 70 from a non-conductive fluid jet 63 as per an example embodiment of the present invention. Fluid supply 64 contains non-conductive donor fluid 62 under pressure which forces non-conductive donor fluid 62 through nozzle channel 20 in the form of a jet. Droplet stimulation electrode 100 is preferably made from an electrically conductive material, and is preferably concentric with an exit orifice 21. Droplet stimulation electrode 100, along with droplet stimulation driver 102 electrohydrodynamically are operable for stimulating a jet of non-conductive fluid into a stream of droplets.

Droplet stimulation electrode 100 is configured such that it is in direct electrical communication with non-conductive donor fluid 62. As such, droplet stimulation electrode 100 is electrically conductive, or includes at least one electrically conductive electrical contact layer 112 or portion that is in intimate contact with non-conductive donor fluid 62. Electrical contact layer 112 should be produced from materials that have appropriate wear resistance and chemical resistance with respect to the composition of non-conductive donor fluid 62.

Droplet stimulation electrode 100 may be constructed by a variety of micromachining methods, and may be formed on or from a substrate 110. Electrical contact layer 112 may be made from a surface metallization layer. The surface metallization layer is typically deposited on one or more insulating layers 114, especially when substrate 110 possesses conductive properties. Substrates 110 suitable for the embodiments of the present invention may include, but are not limited to materials such as glass, metals, polymers, ceramics and semiconductors doped to various conductivity levels.

Figure 4:
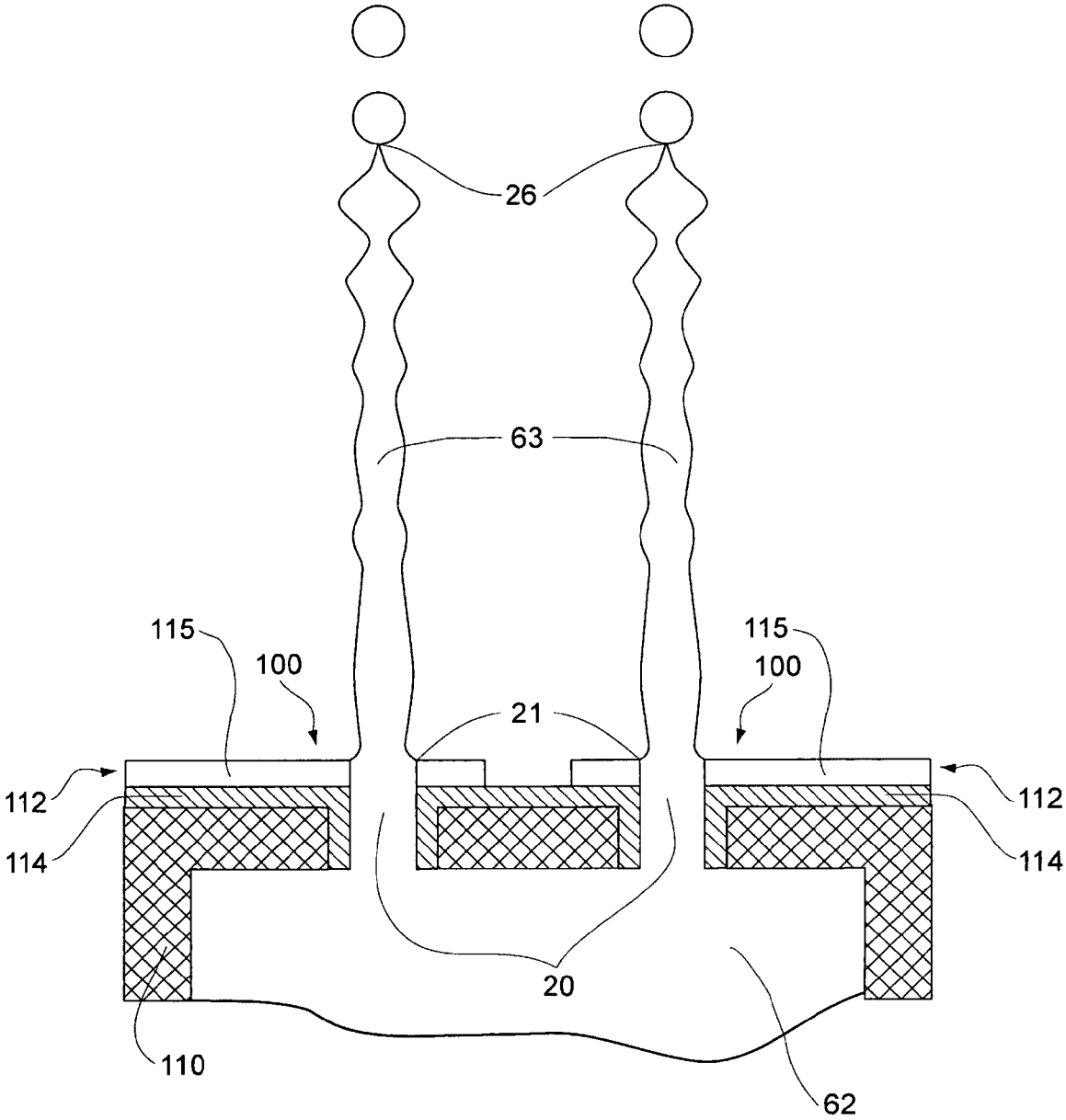
FIG. 4 is a cross-sectional view of an apparatus including another example embodiment of a droplet stimulation device made in accordance with the present invention.

FIG. 4 shows a cross-sectional view of a substrate 110 that includes a plurality of droplet stimulation electrodes 100 as per another example embodiment of the present invention. Each of the droplet stimulation electrodes 100 includes an electrical contact layer 112 that surrounds the exit orifices 21 of the nozzle channels. In this embodiment of the present invention, the electrical contact layers are formed as a metal layer 115 which is deposited on an insulating layer 114. Insulating layer 114 isolates the metal layer 115 from substrate 110, which in this embodiment of the invention is a conductive substrate. The nozzle channels 20 and their corresponding exit orifices 21 may be formed by etching, preferably by a reactive ion etch. Insulating layer 114 that is preferably made from silicon dioxide, may also be applied to the inner surfaces of nozzle channels 20 to add further electrical isolation between metal layer 115 and substrate 110. Optionally, metal layer 115 may also be applied over portions of insulating layer 114 that may cover the inner surfaces of nozzle channels 21. Referring back to FIG. 3, nozzle channel 20 may be defined by corresponding openings in substrate 110, insulating layer 114 and electrical contact layer 112 which are formed into an integrated assembly. In FIG. 4, electrical contact layer 112 defines exit orifice 21 from which jet 63 is emitted.

Figure 5:
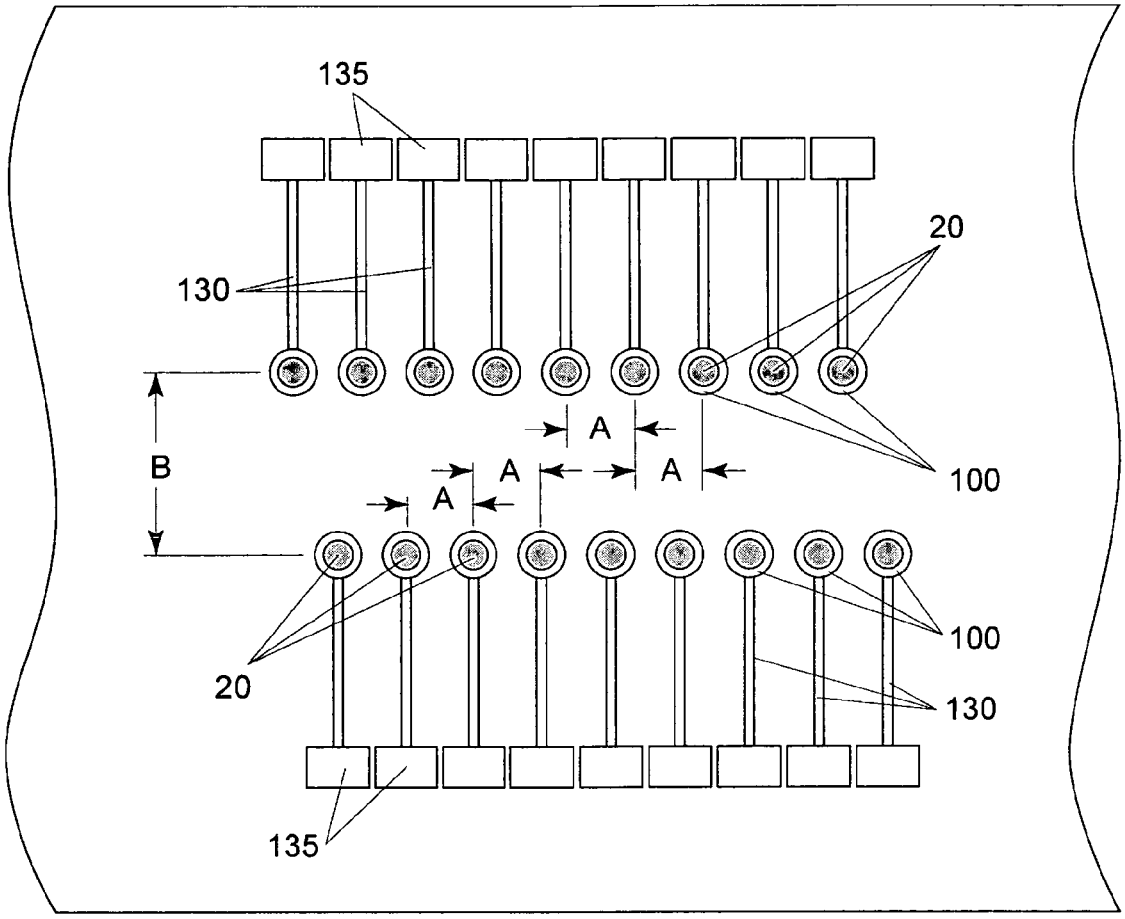
FIG. 5 is a plan view of an apparatus including another example embodiment of a droplet stimulation device made in accordance with the present invention.

As shown in FIG. 5, electrical contact layer 112 may be patterned around nozzle channels 20 to form various isolated electrical pathways 130 to each of the droplet stimulation electrodes 100 positioned at each of the nozzle orifices 20. Electrical contacts 135 may be made to each independent pathway. Electrical leads may be attached to the electrical pathways by a means such as wire bonding. A separate droplet stimulation driver 102 (like the one shown in FIG. 3, for example) may be connected to each electrical lead in order to independently drive each of the electrodes surrounding the nozzle bores. Alternatively, droplet stimulation drivers 102 may be incorporated into substrate 110. In other embodiments of the present invention, electrical contact layer 112 is not patterned to form independent electrical pathways. In such embodiments, all the nozzles are driven in tandem with a single common droplet stimulation driver 102. In yet other embodiments of the present invention, the electrical contact layer 112 may be patterned to drive a group of nozzle simultaneously while driving one or more additional nozzles independently.

In FIG. 5, two parallel rows of nozzles are arranged on a substrate. Nozzle channels 20 within each row are separated from each other by a fixed spacing, A and the rows themselves are separated from one another by a distance, B. In this embodiment of the present invention, the nozzle channels 20 in each of the two rows both have the same center-to-center spacing A, but the rows themselves may be offset from one another by a portion of this spacing. This construction allows two rows of nozzles with greater spacing (i.e. a lower resolution) to form a system with combined smaller effective spacing (a higher resolution). The separation of both the rows by spacing B, and the nozzles within a given row by a spacing A will typically permit more room for electrical contacts 135 on the substrate surface and thereby reduced interaction between the electrically conductive pathways 130, as well as reduced electrostatic interactions between droplets generated by different nozzles channels 20. Other embodiments of the present invention may incorporate different arrangements of nozzles channels 20 and droplet stimulation electrodes 100.

Referring back to FIG. 4, when electrical contact layer 112 includes metal layer 115, one or more nozzles channels 20 can be etched in substrate 110 prior to patterning a metal layer 115 around the nozzle channels 20. Alternatively, metal layer 115 can be first patterned onto substrate 110 such that the pattern is suitably registered with the intended location of the nozzle channels 20. Using the patterned metal layer as a mask, nozzles channels 110 may then be etched through substrate 110.

Although the electrical contact layer 112 is a metal layer in the example embodiment described in FIG. 4, other materials that are sufficiently conductive and possess properties that are compatible with a desired non-conductive fluid to be jetted may be used. When MEMS fabrication techniques are employed, droplet stimulation electrode 100 may be made from suitable semiconductor substrates that provide the necessary properties including conductivity. Additionally, although it is preferable that the droplet stimulation electrodes described herein be produced using MEMS fabrication techniques, these are not the only fabrication techniques that can be used. As such, additional embodiments of the invention may include droplet stimulation electrodes produced from any appropriate materials using any appropriate fabrication techniques known in the art.

In the example embodiments of the present invention shown in FIGS. 3, 4 and 5, openings in the electrical contact layer 112 are positioned and sized around each of the exit orifices 21 so that the electrical contact layer is in direct intimate contact with the non-conductive donor fluid 62 as it is jetted from the exit orifices 21. The position of electrical contact layer 112 is not limited to the embodiments shown these figures. Alternate embodiments of the present invention may include, but are not limited to, positioning an electrical contact layer 112 on an inner surface of the nozzle channel 20 itself. Placement of droplet stimulation electrode 100 may vary so long as the electrical contact layer 112 intimately contacts the non-conductive donor fluid 62 such that a charge can be transferred to non-conductive donor fluid 62 in order to stimulate non-conductive fluid jet 63 to form stream droplets 70.

Under the influence of the droplet stimulation driver 102, droplet stimulation electrode 100 is typically driven to a potential that is relative to a ground point located at some point on the apparatus. One possible location of the ground point may be a portion of a conductive substrate that makes up the nozzle plate comprising the one or more nozzles channels 20 as shown in FIG. 3. The amount of charge transferred to the fluid jet 62 at a given stimulation potential will vary depending on the location of the ground and will be typically become smaller as the ground point is moved further away from the droplet stimulation electrode.

In the example embodiment of the present invention shown in FIG. 3, an electrohydrodynamic stimulation of non-conductive fluid jet 63 forms the stream of droplets 70. The forming of droplets may result from an outward radial pressure buildup that arises from the repulsion of "like" charges that are transferred to the surface of the jet 63 by droplet stimulation electrode 100. Although this embodiment of the invention describes a build up of electrohydrodynamic pressures due to a transfer of charge to the jet of non-conductive fluid, these electrohydrodynamic pressures may be generated by several mechanisms. A primary mechanism may arise from a coulomb force that acts on a free charge in an electric field. Free charge is typically injected or directly transferred to the fluid from an electrode at high potential in contact with the fluid. Secondary mechanisms of generating electrohydrodynamic pressures in non-conductive fluids may involve charge polarization and the electrostriction effect. Although establishing a charge in the non-conductive fluid to induce EHD pressure effects will typically arise from the primary mechanism of direct charge transfer, it is to be understood that other EHD mechanisms may contribute to the establishment of these effects.

It is also be possible to stimulate a jet of non-conductive fluid to form a stream of droplets by transferring charges of opposite polarity to different regions located around the perimeter of the jet. In such a case, droplets may be formed by a pinching effect that is created by an attraction of the transferred opposite polarity charges. In these cases a droplet stimulation electrode may be spilt into a plurality of corresponding electrodes portions. Each portion of the droplet stimulation electrode may be driven by a separate droplet stimulation driver to charge each respective region of the jet with a charge comprising a desired polarity. Such a case may produce droplets that have a neutral net charge.

Figures 6, 6A:
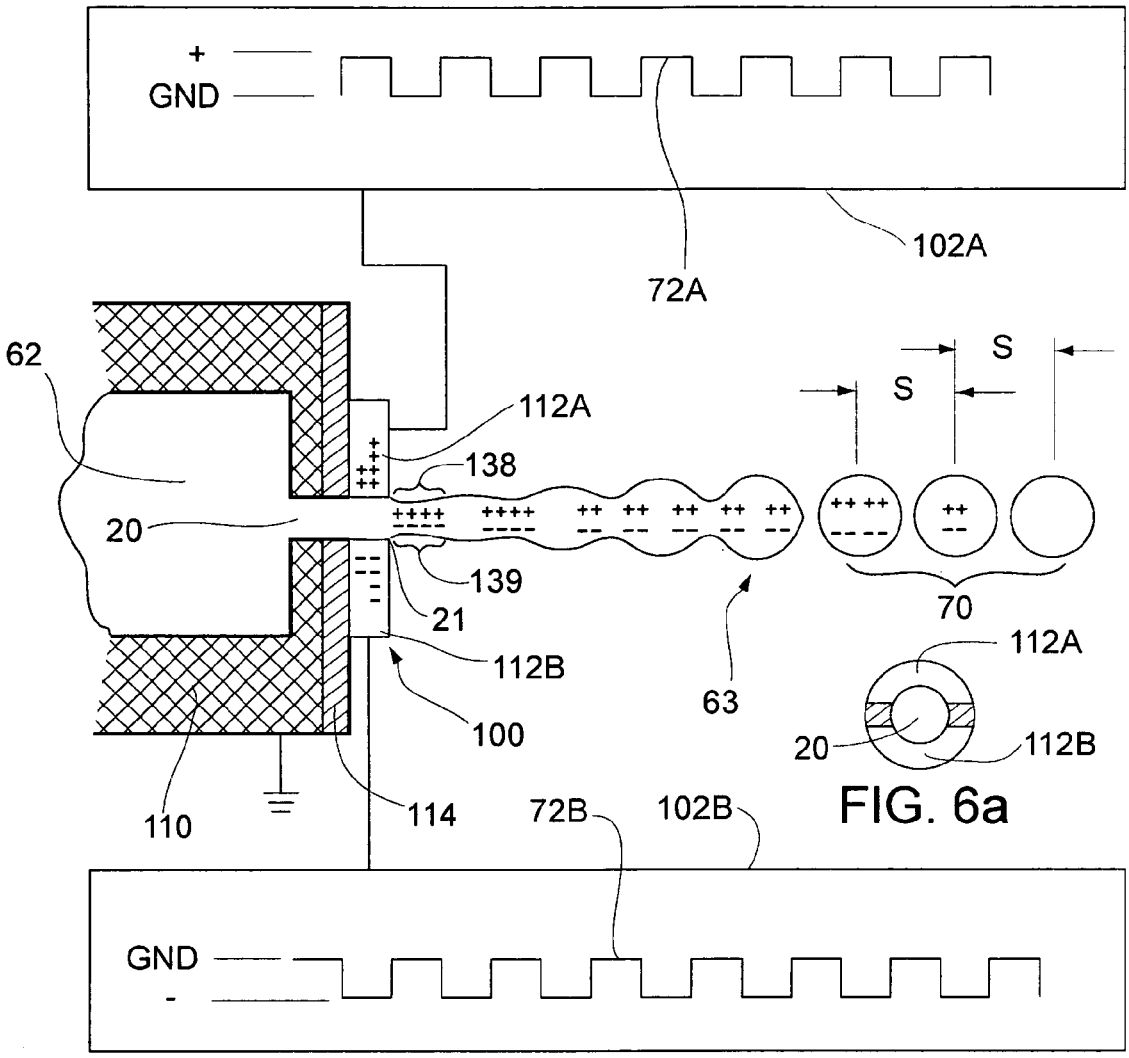
FIG. 6 is a schematic representation of an apparatus employing a droplet stimulation electrode including a plurality of electrically conductive portions.
FIG. 6A is a cross-section view of the droplet stimulation electrode shown in FIG. 6.

FIGS. 6 and 6A show another example embodiment of droplet stimulation electrode 100 according to the present invention. Droplet stimulation electrode 100 includes a plurality of electrically conductive portions 112A and 112B. In this embodiment, droplet stimulation electrode 100 is divided into two electrical contact layer portions 112A and 112B, with each layer being arranged to be in intimate contact with opposing regions of non-conductive fluid jet 63. Separate droplet stimulation drivers 102A and 102B are electrically connected to the separate electrical contact layer portions 112A and 112B. Droplet stimulation drivers 102A and 102B are driven with by two droplet stimulation signals 72A and 72B. Each of the droplet stimulation signals can comprise, for example, uni-polar square signal waveforms with a 50% duty cycle. Although the two signal waveforms have substantially equivalent amplitudes and wavelengths, they differ from one another in that they have opposite polarity when compared to each other.

Under the influence of droplet stimulation signals 72A and 72B, corresponding potential waveforms are created in which positive charge is applied to a first region 138 of a portion of non-conductive fluid jet 63 while negative charge is applied to a second region 139 of a portion of non-conductive fluid jet 63. Preferably, the regions are located on opposing sides of each other. With equal and different polarities applied to the opposing regions of non-conductive fluid jet 63, the net charge on the jet segment comprising the two regions is substantially zero. However, an attraction between these opposite charges creates an electrohydrodynamic pinching effect on the non-conductive fluid jet 63 at these regions. Droplets subsequently form from at least the regions of the jet located between the dissimilarly charged regions. Further, since an equal distribution of positive and negative charges is transferred to droplets after break-off, the droplets 70 are substantially neutral in total charge. The formed droplets are substantially equally charged and substantially equally sized. Preferably, both droplet stimulation signals 72A and 72B are synchronized such that the opposing regions of unlike charge distribution are positioned to create the pinching effect.

It should be noted that the stimulation effect illustrated by the droplet stimulation electrode 100 embodiment shown in FIG. 3 can also be substantially recreated with the electrode embodiment shown in FIG. 6 by simply synchronously providing droplet stimulation signals with the same identical waveforms (polarity included) to each of the droplet stimulation drivers 102A and 102B.

Referring back to FIG. 3, droplet stimulation driver 102 generates a potential waveform (not shown) of chosen voltage amplitude, period and functional relationship with respect to time. This potential waveform will alternately charge various regions of non-conductive fluid jet 63 As herein described, a region of a non-conductive fluid jet may comprise any area of the jet that is intimately contacted by an electrical contact surface of a droplet stimulation electrode, regardless of whether charge is, or is not transferred to the region. As such, a region may comprise a complete surface area that extends around the perimeter of the jet, or a portion of the complete surface area. In accordance with the droplet generation characteristics that are desired, charged regions 120 represent various charged portions of fluid jet 63 while uncharged regions 125 represent other uncharged portions of the jet. For a correctly chosen frequency of the potential waveform, a perturbation resulting from these charged and uncharged regions will grow on non-conductive fluid jet 63 until droplets break-off from the jet at a point further downstream.

The break-off of droplets from the non-conductive fluid jet 63 occurs at break-off point 26. For the sake of clarity, this droplet break-off is exaggerated in FIG. 3 and the start of break-off may take on the order of many droplet spacings; typically 20 S wherein "S" is a center-to-center separate distance between the formed droplets. During the electrohydrodynamic formation of droplets in prior art continuous inkjet printers, any local charge redistribution due to the stimulation quickly vanishes because a conductive fluid is used. In the present invention, charges that are transferred to the non-conductive fluid jet 63 as a consequence of the EHD stimulation of that jet are not quickly dissipated. As shown in FIG. 3, droplets will form as the non-conductive fluid jet 63 separates in the areas between the charged regions. 120. A non-limiting example of droplet stimulation signal 72 includes a uni-polar square wave with a 50% duty cycle. As shown in FIG. 3, each of the resulting droplets will be of substantially equal size or volume and will be equally spaced from one another by an equal center-to-center distance, S, since the stimulation signal 72 waveform is uniform and cyclical in nature. The formed droplets will each have substantially the same charges since each of the charges transferred to charged regions 120 are subsequently isolated within each of the droplets that break off from a corresponding charged region 120. Droplet charge levels and uniformity of charging is controlled by the potential waveform that is applied to the droplet stimulation electrode 100 and any leakage of charge through fluid jet 63 prior to droplet break-off. This embodiment of the present invention discloses a droplet stimulation means that gives rise to the simultaneous stimulation and charging of droplets from a non-conductive fluid jet.

Embodiments of the present inventions allow for a charge that induces droplet stimulation from a non-conductive fluid jet to get "locked-in" the subsequently formed droplets. This "locking-in" of charge may allow the formed droplets to be characterized for different purposes that may include being printed with, or not being printed with. Characterization typically requires modifying the droplet stimulation signal 72 such that various portions of its waveform will not necessarily be identical during the formation of selected droplets formed from stimulated non-conductive jet 63. Portions of the droplet stimulation signal 72 waveform may be varied in some form including, but not limited to, amplitude, duration, duty cycle and polarity. Portions of the droplet stimulation signal 72 waveform may be varied to characterize selected droplets within the stream of droplets 70 with different charge levels or different sizes. Such modification of droplet stimulation signal 72 may potentially vary the time to break-off of differently characterized droplets, but does not fundamentally affect the droplet stimulation mechanism as taught by embodiments of the present invention.

Non-conductive fluids suitable for droplet stimulation according to embodiments of the present invention may be defined by a range of resistivities whose numerical values may be determined by parameters including, but not limited to, the time to droplet break-off, the fluid jet diameter, and the center-to-center distance S between the formed droplets. According to the embodiments of the invention described herein, droplet stimulation of a non-conductive fluid jet is made possible since once charges are transferred to the various regions of the jet, the charges have exceptionally limited capability to dissipate or to migrate along the length of the jet. Preferably, transferred charges should not be able to discharge or migrate more than the center-to-center distance S of the subsequently formed droplets. A time required for a discharge or migration of the transferred charges preferably should not be greater than the cumulative time required to transfer a charge to a charged region 120 of the fluid jet 62 and then incorporate that charged region 120 into a corresponding droplet at break-off point 26.

Estimates of the non-conductive fluid resistivity range required for droplet stimulation may be determined by requiring that a discharge time constant, $T_{RC}$ of the transferred charges be of the same duration, or longer than a droplet time-to-break-off interval, $T_b$. Therefore, $T_{RC} \geqq T_b$. Time-to-break-off interval, $T_b$ may be measured from the time charge is transferred from electrical contact layer 112 to a given charged region 120 to the time a specific droplet is formed at break-off point 26 from that given region. Time-to break-off interval $T_b$ will typically vary as a function of the electrohydrodynamic stimulation strength, the diameter of fluid jet 62, and the non-conductive fluid properties themselves.

Estimates of the discharge time constant, $T_{RC}$, may be made by modeling a non-conductive fluid jet as a fluid column in free space surrounded by a grounded cylindrical surface. A capacitance per unit length, $C_L$ of the fluid column may be estimated by the relationship:

$$C_L=2\pi\in/|1n(r_j/r_g)|, \text{ where:}$$

$r_j$ is a radius of the non-conductive fluid jet, $r_g$ is a radius of the surrounding cylindrical grounding surface, and $\in$ is the permittivity of the medium surrounding the non-conductive fluid jet.

When the non-conductive fluid jet is surrounded by air, the value of $\in$ in the above relationship differs only marginally from the permittivity in free space or vacuum denoted as $\in_0$. Accordingly, $\in=\in_{air}=1.0006\in_0$ (at atmospheric pressure, 20 degrees Celsius). Other types surrounding mediums may alter the effective permittivity such that $\in=\in_{eff}*\in_0$, wherein $\in_{eff}>1$. For the purpose of making an estimate of capacitance per unit length, $\in=\in_0$ may be used to calculate a lower limit of capacitance. As previously stated, various ground points may be located on an apparatus defined by the present invention. Although these ground points may be located proximate to non-conductive fluid jet 63, modeling the reference ground as a distantly positioned surrounding grounded cylindrical surface may be used to provide a lower limit for the capacitance per unit length and hence, a lower limit for the discharge time constant $T_{RC}$.

For embodiments of the invention in which charge dissipation over a maximum jet length of one droplet-to-droplet spacing, S is acceptable, the total capacitance C for a length of the non-conductive fluid jet equal to droplet-to-droplet spacing S may be estimated by the relationship: $C=C_L\cdot S$. The resistance R of a length S of the non-conductive fluid jet may be estimated by the relationship:

$$R=\rho_f S/(\pi\cdot r_j^2), \text{ where}$$

variables S and $r_j$ are as previously defined, and variable $\rho_f$ is the resistivity of the non-conductive fluid.

The discharge time constant is given by the relationship: $T_{RC}=RC$. Accordingly, a minimum resistivity, $\rho_f$ of a non-conductive fluid required for droplet stimulation as described by embodiments of the present invention may be estimated by the following relationship:

$$\rho_f\geqq|T_b(\tfrac{1}{2}\in)(r_j^2/S^2)1n(r_j/r_g)|, \text{ where:}$$

$r_g$ is a radial distance from the jet to the surrounding cylindrical grounding surface, and variables $T_b$, $\in$, $r_j$ and S are as previously defined with $\in$ being substantially equal to $\in_0$ when an air atmosphere is present.

As an example, for a jet radius $r_j$=5 um, a grounding radius $r_g$=1 m, a droplet center-to-center distance, S=50 um, and a time to break-off, $T_b$=0.1 msec, a required non-conductive fluid resistivity, $\rho_f$ would be in excess of ~70 MΩ-cm. This value is on the order of the resistivity of ultra pure water (approximately 18 MΩ-cm). This exemplified estimated level of resistivity may be considered to be an approximate lower limit, which may or may not preclude using numerous aqueous inks in embodiments of the present invention. However, inks made with low viscosity high resistivity fluids have resistivity levels that are typically many orders of magnitude above the estimated minimum. An example of such a fluid is isoparaffin with a resistivity of $2\cdot10^{13}$ Ω-cm. It is to be noted that the above exemplified estimated resistivity level is very conservative since it was based on a model that specified a non-conductive fluid jet-to-ground distance of 1 meter. In practical applications of embodiments of the present invention, non-conductive fluid jet-to-ground distances are likely to be much closer thereby allowing for a lower non-conductive fluid resistivity limit. Practical lower limits for the resistivity of a non-conductive fluid employed in embodiments of the present invention may be as low as 1 MΩ-cm depending on the grounding configuration used.

Embodiments of the present invention have described methods of transferring charge to a non-conductive fluid jet to form a stream of droplets. This transfer of charge may also include a transfer of charge to characterize a droplet with a certain charge polarity. The transfer of charge may also include the transfer of charge to stimulate the jet to selectively form droplets of a desired shape, volume or size characteristic. The charge transferred to a non-conductive fluid jet is typically locked-in, unlike a charge that is applied to a conductive fluid jet. For a given level of charging, the arising electrohydrodynamic stimulation as described in embodiments of the present invention, is typically stronger than that of prior art techniques involving an electrohydrodynamic stimulation of conductive fluids.

The strength of the droplet forming stimulation is typically proportional to the internal radial pressure created by the electrohydrodynamic effect on charged regions of non-conductive fluid jet 63. A radial pressure, P due to a charge transferred to a region of jet 63 may be estimated by the following relationship:

$$P=1/(2\in)\cdot\sigma^2, \text{ where}$$

variable $\in$ is as previously defined and is substantially equal to $\in_0$ when an air atmosphere is present, and $\sigma$ is a charge density, that in turn may be derived by the relationship:

$$\sigma=q/(2\pi r_j\cdot S), \text{ where}$$

variable q is a resulting droplet charge, and variables $r_j$ and S are as previously defined.

By example, for a resulting droplet charge on the order of q=100 fC, a droplet center-to-center distance, S=50 um, and a jet radius, $r_j$=5 um, the radial pressure P on the jet may be estimated to be approximately 230 Pa. This radial pressure value is similar to induced pressures created by prior art EHD droplet stimulation electrodes employed to stimulate conductive fluid jets. However, the stimulation of non-conductive fluid jets as per embodiments of the present invention typically acts on a jet for a greater duration of time than would occur with a similar stimulation of a conductive fluid jet. This extended duration is due to the relative immobility of transferred charge on the non-conductive fluid jet. Therefore, the non-conductive EHD stimulation provided by embodiments of the present invention may be considered to be stronger than that of prior art conductive fluid EHD stimulators.

A corresponding upper limit of a potential, V required for the transfer of charge during droplet stimulation of the various embodiments of the present invention may be estimated by the following relationship:

$$V=q/C, \text{ where}$$

variables q and C are as previously defined.

The potential V may be estimated to be 430 volts for the previously example in which q=100 fC, S=50 um, $r_j$=5 um, and wherein $r_g$ is additionally taken to equal 1 m. The capacitance value C used to obtain this estimate was based upon the derived capacitance per unit length of the non-conductive fluid jet located in free space inside a large diameter grounded cylindrical surface. Accordingly, this capacitance value may be considered to be a lower limit, and consequently an upper limit for the potential estimated by the above relationship. In actual practice, the capacitance of non-conductive fluid jet 63 with respect to the droplet stimulation electrode 100 is a function of the geometry of the electrode shape, and the position of the electrode 100 near the non-conductive fluid jet 63. The actual capacitance value is typically higher than that of the above estimated capacitance value. Hence, the potential may be much lower than estimated above, especially with a suitable choice of electrode geometry and with an added placement of a nearby ground electrode to further increase the capacitance.

The example embodiment of the present invention illustrated in FIG. 3 discloses a single nozzle channel. Other example embodiments of the present invention may also include a group or row of multiple nozzles or multi-jet or multi-rows of nozzles. Various apparatus incorporating embodiments of the preset invention may include without limitation, continuous inkjet and multi-jet continuous inkjet apparatus.

The invention has been described in detail with particular reference to certain preferred embodiments thereof, but it will be understood that variations and modifications can be effected within the scope of the invention.

PARTS LIST

10 fluid supply
12 conductive fluid
13 prior art conductive electrode structure
15 prior art droplet stimulation electrode
17 prior art stimulation signal driver
19 stimulation signal
20 nozzle channel
21 exit orifice
22 prior art conductive fluid jet
24 insulating layers
26 break-off point
30 charge electrode
32 charge electrode driver
34 charged droplets
36 uncharged droplets
38 electrostatic deflection plates
40 gutter
42 receiver surface
50 printing apparatus
52 housing
54 interior chamber
56 print-head
58 translation unit
60 system controller
62 non-conductive donor fluid
63 non-conductive fluid jet
64 source of pressurized non-conductive donor fluid
65 first direction
66 droplet generation circuit.
70 stream of droplets
72 droplet stimulation signal
72A droplet stimulation signal
72B droplet stimulation signal
74 droplet separation means
76 motor
78 rollers
100 droplet stimulation electrode
102 droplet stimulation driver
102A droplet stimulation driver
102B droplet stimulation driver
110 substrate
112 electrically conductive electrical contact layer
112A electrical contact layer portion
112B electrical contact layer portion
114 insulating layer
115 metal layer
120 charged regions
125 uncharged regions
130 conductive pathways
135 electrical contacts
137 conductive ground ring
138 a first region of a portion of non-conductive fluid jet 63
139 a second region of a portion of non-conductive fluid jet 63

The invention claimed is:

1. An apparatus for forming fluid droplets comprising:
a nozzle channel;
a pressurized source of a non-conductive fluid in fluid communication with the nozzle channel, the pressurized source being operable to form a jet of the non-conductive fluid through the nozzle channel; and
a stimulation electrode for forming fluid droplets, at least one portion of the stimulation electrode being electrically conductive and contacting with a portion of the non-conductive fluid jet, the at least one electrically conductive portion of the stimulation electrode being operable to transfer an electrical charge to a region of the portion of the non-conductive fluid jet, wherein the electrical charge stimulates the non-conductive fluid jet to form a non-conductive fluid droplet, and wherein a resistivity of the non-conductive fluid required for droplet stimulation is determined by requiring that a discharge time constant $T_{RC}$ of transferred charges be of the same duration or longer than a droplet time-to-break-off interval $T_b$ ($T_{RC} \geqq T_b$).

2. The apparatus of claim 1, the nozzle channel including an exit orifice, wherein the at least one electrically conductive portion of the stimulation electrode is positioned proximate to the exit orifice of the nozzle channel.

3. The apparatus of claim 1, the nozzle channel including an inner surface, wherein the at least one electrically conductive portion of the stimulation electrode is positioned on the inner surface of the nozzle channel.

4. The apparatus of claim 1, the nozzle channel being formed in a substrate, the apparatus further comprising:
an electrically insulating member positioned between the substrate and the at least one electrically conductive portion of the stimulation electrode.

5. The apparatus of claim 1, wherein the at least one electrically conductive portion of the stimulation electrode includes a metal material.

6. The apparatus of claim 1, further comprising:
a droplet stimulation driver in electrical communication with the stimulation electrode, the droplet stimulation driver being operable to receive a droplet stimulation signal and provide a voltage potential waveform to the stimulation electrode in response to the droplet stimulation signal.

7. The apparatus according to claim 1, further comprising:
a system controller in electrical communication with the stimulation electrode, the system controller being operable to provide a droplet stimulation signal to the stimulation electrode to create the electrical charge.

8. The apparatus of claim 1, wherein the at least one portion of the stimulation electrode for forming fluid droplets including a first portion and a second portion, each of the first and second portions being electrically conductive and contactable with the non-conductive fluid jet, the first portion being operable to transfer a first electrical charge to the non-conductive fluid jet, the second portion being operable to transfer a second electrical charge to the non-conductive fluid jet.

9. The apparatus of claim 1 wherein a minimum resistivity $\rho_f$ of the non-conductive fluid required for droplet stimulation satisfies the relationship $\rho_f \geqq |T_b(\frac{1}{2}\in)(r_j^2/S^2)\ln(r_j/r_g)|$, in which:

$T_b$ is the droplet time-to-break-off interval;

$\in$ is a permittivity of a medium surrounding the non-conductive fluid jet;

$r_j$ is a radius of the non-conductive fluid jet;

$r_g$ is a distance from the non-conductive fluid jet to a ground surface; and

S is a center-to-center distance between successively formed fluid droplets.

10. The apparatus of claim 1 wherein the resistivity of the non-conductive fluid required for droplet stimulation is as low as 1 MΩ-cm.

11. The apparatus according to claim 6, further comprising:

a system controller in electrical communication with the droplet stimulation driver, the system controller being operable to provide the droplet stimulation signal to the droplet stimulation driver.

12. The apparatus of claim 6, wherein the droplet stimulation driver is operable to vary the voltage potential waveform provided to the stimulation electrode in response to the droplet stimulation signal received by the droplet stimulation driver.

13. The apparatus of claim 7, wherein the droplet stimulation signal is such that a plurality of non-conductive fluid droplets are formed, each of the plurality of non-conductive fluid droplets having a substantially equivalent volume.

14. The apparatus of claim 8, further comprising:

a first droplet stimulation driver in electrical communication with the first portion of the stimulation electrode for forming fluid droplets, the first droplet stimulation driver being operable to receive a first droplet stimulation signal and provide a voltage potential waveform to the first portion of the stimulation electrode in response to the first droplet stimulation signal; and a second droplet stimulation driver in electrical communication with the second portion of the stimulation electrode for forming fluid droplets, the second droplet stimulation driver being operable to receive a second droplet stimulation signal and provide a voltage potential waveform to the second portion of the stimulation electrode in response to the second droplet stimulation signal.

15. The apparatus according to claim 14, further comprising:

a system controller in electrical communication with the first and second droplet stimulation drivers, the system controller being operable to provide the first and second droplet stimulation signals.

* * * * *

UNITED STATES PATENT AND TRADEMARK OFFICE

CERTIFICATE OF CORRECTION

PATENT NO. : 7,658,478 B2
APPLICATION NO. : 11/235831
DATED : February 9, 2010
INVENTOR(S) : Thomas W. Steiner et al.

It is certified that error appears in the above-identified patent and that said Letters Patent is hereby corrected as shown below:

| Issued Patent | | Description of Error |
|---|---|---|
| **Column** | **Line** | |
| 12 | 52 | In the Specification, delete “not” after “should”. |

Signed and Sealed this
Sixteenth Day of August, 2011

David J. Kappos

David J. Kappos
*Director of the United States Patent and Trademark Office*